US005641601A

United States Patent [19]

Mitani et al.

[11] Patent Number: 5,641,601

[45] Date of Patent: Jun. 24, 1997

[54] ELECTROPHOTOGRAPHIC TONER WITH MAGNETIC PARTICLE ADDITIVE

[75] Inventors: Shuji Mitani; Kazuhiro Sato; Kazuhiko Mizuno; Yoshiyuki Hasegawa, all of Shizuoka, Japan

[73] Assignee: Tomoegawa Paper Co., Ltd., Tokyo, Japan

[21] Appl. No.: 631,218

[22] Filed: Apr. 12, 1996

[30] Foreign Application Priority Data

Apr. 13, 1995 [JP] Japan ..... 7-112530

[51] Int. Cl.$^6$ ..... G03G 9/083

[52] U.S. Cl. ..... 430/106.6; 430/111; 430/903

[58] Field of Search ..... 430/106.6, 111

[56] References Cited

U.S. PATENT DOCUMENTS 4,820,603 4/1989 Sakashita et al. ..... 430/106.6

4,975,214 12/1990 Sakashita et al. ..... 430/106.6

5,164,780 11/1992 Ohno et al. ..... 43/105

5,296,326 3/1994 Taya et al. ..... 430/111

5,364,720 11/1994 Nakazawa et al. ..... 430/106.6

*Primary Examiner*—Roland Martin

*Attorney, Agent, or Firm*—Cushman Darby & Cushman IP Group of Pillsbury Madison & Sutro, LLP

[57] ABSTRACT

An electrophotographic toner suitable for use in an image-forming apparatus employing an organic photoconductor is disclosed which comprises toner particles and, adherent to the surface thereof, magnetic particles having an FeO content of 17% by weight or lower, a specific surface area of from 2.5 to 6 $m^2/g$, and an octahedral or hexahedral particle shape. The toner functions to prevent toner components and paper dust from adhering to the surface of an organic photoconductor, and has satisfactory moisture resistance.

4 Claims, No Drawings

ELECTROPHOTOGRAPHIC TONER WITH MAGNETIC PARTICLE ADDITIVE

FIELD OF THE INVENTION

The present invention relates to an electrophotographic toner. More particularly, this invention relates to a toner suitable for use in an image-forming apparatus employing an organic photoconductor.

BACKGROUND OF THE INVENTION

In recent years, organic photoconductors are used in many copiers and printers in place of selenium-containing photoconductors. However, since organic photoconductors are inferior to selenium-containing photoconductors in surface hardness and abrasion resistance, limitations are imposed in designing the image-forming apparatuses employing an organic photoconductor. For example, the contact pressure at which the cleaning blade comes into contact with the organic photoconductor to remove the toner remaining on the surface of the organic photoconductor should be reduced, and the hardness of the cleaning blade itself should be lowered. Organic photoconductors further have a problem that toner components and paper dust are apt to adhere to the surface of the organic photoconductors because the photoconductor surface comprises an organic compound. In this case, once paper dust and toner components adhere to the surface of an organic photoconductor, they are difficult to completely remove with the cleaning blade. Namely, the problem is that such paper dust and toner components accumulate on the surface of the organic photoconductor during repeated use and, as a result, an image soiled with spots or streaks is formed on receiving paper.

To prevent such deposition on organic photoconductors, it has been proposed to use electrophotographic toners containing a titanic acid/metal compound, e.g., strontium titanate, or an abrasive material, e.g., alumina or titanium oxide, adherent to the toner surface to thereby abrasively remove paper dust and other adherent substances from the photoconductor surface.

However, these proposed techniques not only are disadvantageous in that the material cost is relatively high, but have the following problem since the prior art toners are low in the ability to abrasively remove paper dust and other adherent substances. In the case where copying or printing is continuously performed on sheets of paper of the same size, paper dust clinging to edges (cut surfaces) of paper sheets adheres to the organic photoconductor and accumulates on the same areas of the photoconductor surface to cause copy soil, etc. If the amount of the abrasive material adherent to toner particles is increased in order to improve the effect of abrasive removal, the amount of charges which the toner can possess in a high-humidity atmosphere is considerably reduced to pose problems of increased toner consumption and enhanced blurring. Thus, with the conventional electrophotographic toners, it has been impossible to satisfy both of the prevention of the adhesion of toner components and paper dust to the surface of an organic photoconductor and satisfactory moisture resistance.

SUMMARY OF THE INVENTION

An object of the present invention is to provide an electrophotographic toner suitable for use in an image-forming apparatus employing an organic photoconductor, which functions to prevent toner components and paper dust from adhering to the surface of the organic photoconductor and has satisfactory moisture resistance.

Intensive studies were made in order to develop a toner which, even when used in continuous copying or continuous printing on sheets of paper of the same size, does not cause the adhesion of paper dust or toner components to the surface of the organic photoconductor, and which has satisfactory moisture resistance. As a result, a novel electrophotographic toner has been invented.

The present invention provides an electrophotographic toner for use in an image-forming apparatus employing an organic photoconductor which toner comprises toner particles and, adherent to the surface thereof, magnetic particles having an FeO content of 17% by weight or lower, a specific surface area of from 2.5 to 6 $m^2/g$, and an octahedral or hexahedral particle shape.

DETAILED DESCRIPTION OF THE INVENTION

The magnetic particles characteristic of the present invention are particles of a magnetic material containing FeO, such as, e.g., a ferrite ($MO.FeO.Fe_2O_3$, where M is a divalent metal ion such as $Mn^{2+}$, $Co^{2+}$, $Ni^{2+}$, $Cu^{2+}$, or $Zn^{2+}$) or magnetite ($FeO.Fe_2O_3$), and having an FeO content of 17% by weight or lower. The lower limit of the FeO content is generally 3% for obtaining blackness of the toner. These particles have a specific surface area of from 2.5 to 6 $m^2/g$ and an octahedral or hexahedral particle shape.

In the present invention, the FeO content of magnetic particles means the value determined in accordance of JIS M 8213, while the specific surface area thereof can be determined by the BET method based on nitrogen gas adsorption. The particle shape thereof can be ascertained by analyzing an electron photomicrograph thereof.

Magnetic particles having an FeO content exceeding 17% by weight are undesirable even when having an octahedral or hexahedral particle shape and a specific surface area of from 2.5 to 6 $m^2/g$. This is because since such magnetic particles are apt to adhere to the surface of an organic photoconductor, magnetic particles themselves separate from the toner surface and adhere to the organic-photoconductor surface. The magnetic particles adherent to the organic-photoconductor surface accelerate the adhesion of paper dust, fine toner particles, and toner components, e.g., silica serving as a toner fluidizer, to soil copy images with black spots, making it impossible to accomplish the object of the present invention. In order for magnetic particles to be prevented from adhering to the surface of an organic photoconductor, the particles should have an FeO content of 17% or lower. The preferred range of the content of FeO is from 5 to 17% by weight. Magnetic particles having an FeO content lower than 5% by weight are unsuitable for use in applications where the electrophotographic toner is required to be black. Such magnetic particles are prevented from adhering to the surface of an organic photoconductor, but have a reddish brown color with a low degree of blackness.

Magnetic particles having a particle shape other than octahedron or hexahedron are undesirable in that such particles are almost ineffective in preventing the adhesion of toner components and paper dust and are apt to adhere to the surface of an organic photoconductor.

Magnetic particles which have an octahedral or hexahedral particle shape but are fine particles with a specific surface area larger than 6 $m^2/g$ are ineffective in preventing the adhesion of toner components and paper dust. On the other hand, magnetic particles having a specific surface area smaller than 2.5 $m^2/g$ have a reduced proportion of edges because of the increased particle diameter thereof, and are hence almost ineffective in preventing the adhesion of toner components and paper dust.

The magnetic particles which can be used in the present invention (e.g., magnetite) can be obtained as follows. An aqueous solution of iron sulfate is neutralized with an aqueous solution of caustic soda to obtain an iron hydroxide as a product of the neutralization reaction. Thereafter, air is bubbled into the resulting suspension to oxidize the hydroxide to thereby obtain a magnetite precipitate. This precipitate is taken out by filtration, dried, and deagglomerated to obtain magnetite particles. In this process, the content of FeO can be controlled by regulating the conditions for the steps of filtration and drying. Further, higher values of the pH of the liquid neutralized with the aqueous caustic soda, higher temperatures for the oxidation, or smaller amounts of the bubbled air result in larger particle diameters. Hence, by controlling these factors, the specific surface area of the magnetic particles can be regulated to a value in the range of from 2.5 to 6 $m^2/g$.

An alternative method is to expose a commercial magnetic powder to air having a temperature of, e.g., 200° to 210° C. for several hours to reduce the FeO content thereof to 17% or lower.

In the present invention, the amount of the above-described magnetic particles adherent to the surface of the toner particles is preferably from 0.3 to 3% by weight based on the total amount of the toner particles and the magnetic particles. If the amount of the magnetic particles adherent to the toner particles is smaller than 0.3% by weight, the toner is liable to be less effective in preventing the adhesion of toner components and paper dust. On the other hand, if the amount thereof exceeds 3% by weight, there are some cases where the toner has an excessive abrasive action, which may adversely influence the surface of the organic photoconductor itself to impair photoconductor properties. In addition, such a toner has the enhanced ability to form images in a high-humidity atmosphere and this may result in impaired tone reproduction or increased toner consumption.

Conventional magnetite products on the market have an FeO content of about from 22 to 29% by weight.

For adhering magnetic particles to the surface of toner particles to produce the toner of the present invention, use may be made of a method in which the magnetic particles are sprinkled on the toner particles using a mixer such as, e.g., a Henschel mixer or supermixer. Alternatively, a surface-modifying apparatus, e.g., Nara Hybridization System (by Kabushiki Kaisha Nara Kikai Seisakusyo, Japan), may be used to embed at least part of the magnetic particles into the surface of the toner particles. A mixture of the magnetic particles and a fluidizer, e.g., silica, may be used according to purpose.

The toner particles which can be used in the present invention generally have a particle size of 5 to 15 μm, and comprise a binder resin and a colorant as major components.

Examples of the binder resin contained in the toner particles include homopolymers and copolymers of styrene and substituted styrenes, such as polystyrene, and poly(p-chlorostyrene); copolymers of styrene with an acrylic ester, such as styrene-methyl acrylate copolymers, styrene-ethyl acrylate copolymers, and styrene-n-butyl acrylate copolymers; copolymers of styrene with a methacrylic ester, such as styrene-methyl methacrylate copolymers, styrene-ethyl methacrylate copolymers, and styrene-n-butyl methacrylate copolymers; copolymers of styrene with another vinyl monomer, such as styrene-acrylonitrile copolymers and styrene-butadiene copolymers; and other resins including polyesters, epoxy resins, and phenolic resins. These binder resins may be used alone or as a mixture thereof.

Examples of the colorant include carbon black, aniline blue, Chalco Oil Blue, chrome yellow, ultramarine blue, quinoline yellow, methylene blue chloride, phthalocyanine blue, malachite green oxalate, lamp black, Rose Bengal, and mixtures thereof. These colorants should be incorporated in such a proportion as to give a visible image having a sufficient image density. The proportion of the colorant is usually about from 1 to 20 parts by weight per 100 parts by weight of the binder resin.

A charge controlling agent, e.g., a Nigrosine dye or a metal-containing dye, a wax, e.g., low-molecular polyethylene or low-molecular polypropylene, and other additives may be added to the toner particles.

In the electrophotographic toner of the present invention, the toner particles may be magnetic toner particles containing magnetic particles therein, or may be nonmagnetic toner particles not containing magnetic particles therein. The crucial point is that the magnetic particles specified in the present invention should be adhered to the toner surface, and these magnetic particles need not be dispersed into the individual toner particles.

The term "image-forming apparatus employing an organic photoconductor" used herein means, for example, a copier or printer which electrophotographically forms an image using an organic photoconductor comprising a charge carrier-generating layer (CGL) and a charge carrier-transporting layer (CTL) formed thereon.

The charge carrier-generating layer (CGL), for example, comprises poly(vinyl butyral) as a binder and contains a phthalocyanine compound, a bisazo compound, or the like. The charge carrier-transporting layer (CTL), for example, comprises a polycarbonate as a binder and contains a styryl compound, a hydrazone compound, or the like.

The electrophotographic toner of the present invention is presumed to function as follows. The toner and paper dust which have not been transferred to receiving paper and remain on the organic-photoconductor surface are removed by the abrasive action of the specific magnetic particles adherent to the surface of those untransferred toner particles when the magnetic particles are pressed against the organic-photoconductor surface due to the pressure of the cleaning blade and abrade the photoconductor surface. Thus, the adhesion of toner components and paper dust to the organic-photoconductor surface can be presented. In this case, since the magnetic particles have an octahedral or hexahedral particle shape, the edges of each magnetic particle are presumed to function to abrade the organic-photoconductor surface. Furthermore, since the magnetic particles in the present invention have specific values of FeO content and of specific surface area, the surface of the magnetic particles has a reduced affinity for the organic-photoconductor surface, so that the magnetic particles are prevented from separating from the toner particles and adhering to the organic-photoconductor surface.

The present invention will be explained below by reference to Examples and Comparative Examples, wherein all parts are by weight.

Preparation of Toner Particles

Styrene-acrylic ester copolymer resin 100 parts
(monomer composition: styrene/butyl acrylate)

$M_w$=2.0×10$^5$ $M_n$=0.4×10⁴

Carbon black 6 parts (manufactured by Cabot Corp.; trade name, REGAL 400R)

Nigrosine dye 2 parts (manufactured by Orient Chemical Industries Ltd., Japan; trade name, Nigrosine EX)

Polypropylene 2 parts (manufactured by Sanyo Chemical Industries, Ltd., Japan; trade name, Viscol 330P)

The ingredients specified above were dry-blended by means of a Henschel mixer, and then thermally melted and kneaded with a twin-screw extruder. The resulting extrudate was pulverized with a jet mill and then classified with an air classifier to obtain positively electrifiable toner particles having an average particle diameter of 10 μm.

EXAMPLES 1 TO 9 AND COMPARATIVE EXAMPLES 1 TO 5

Using a Henschel mixer, each of particulate magnetic materials A to L shown in Table 1 given below was adhered to the toner particles in the amount (based on the amount of the toner particles) shown in the table, together with 0.2% by weight positively electrifiable hydrophobic silica. Thus, electrophotographic toners according to the present invention and comparative electrophotographic toners were obtained.

TABLE 1

| Sample No. | Identification Symbol | FeO Content (wt %) | Specific Surface Area ($m^2/g$) | Shape | Amount of Adherent Magnetic Particles (wt %) |
|---|---|---|---|---|---|
| Example 1 | A | 13.7 | 3.6 | octahedral | 0.3 |
| Example 2 | A | 13.7 | 3.6 | octahedral | 1.0 |
| Example 3 | A | 13.7 | 3.6 | octahedral | 3.0 |
| Example 4 | B | 16.7 | 3.6 | octahedral | 1.0 |
| Example 5 | C | 5.4 | 3.6 | octahedral | 1.0 |
| Example 6 | D | 12.6 | 5.8 | octahedral | 1.0 |
| Example 7 | E | 13.2 | 2.7 | octahedral | 1.0 |
| Example 8 | F | 12.3 | 2.9 | hexahedral | 1.0 |
| Example 9 | G | 0.9 | 3.6 | octahedral | 1.0 |
| Comparative Example 1 | H | 25.8 | 3.6 | octahedral | 1.0 |
| Comparative Example 2 | I | 13.2 | 2.3 | octahedral | 1.0 |
| Comparative Example 3 | J | 14.8 | 6.8 | octahedral | 1.0 |
| Comparative Example 4 | K | 23.1 | 5.7 | spherical | 1.0 |
| Comparative Example 5 | L | 24.2 | 5.6 | amorphous | 1.0 |

Subsequently, each of the electrophotographic toners was homogeneously mixed with a ferrite carrier having an average particle diameter of 90 μm such that the content of the electrophotographic toner was 4.5% by weight based on the total amount thereof. Thus, developers were produced.

The following evaluation tests were performed using a commercial copier having a two-layer organic photoconductor comprising a charge carrier-generating layer (CGL) and a charge carrier-transporting layer (CTL) formed thereon and a urethane cleaning blade (copying speed, ten laterally arranged A4-size sheets per minute).

The performances evaluated are as follows.

A B5-size original having a percentage of black areas of 7% was continuously copied up to 5,000 sheets in a high-humidity atmosphere having a temperature of 32.5° C. and a relative humidity of 80%. Thereafter, the amount of the consumed toner was ascertained.

Subsequently, an A4-size white original and an A4-size original bearing a halftone image (density, 0.2–0.35) were copied to examine the copy of the white original and that of the halftone-image original to thereby ascertain the adhesion of toner components, paper dust, and magnetic particles on the surface of the organic photoconductor.

In the organic-photoconductor surface, the areas to which toner components and paper dust adhere in the largest amount in the above evaluation method correspond to those two edges of each B5-size paper sheet which are parallel to the direction in which the paper sheets move. Consequently, when toner components and paper dust have adhered to the surface of the organic photoconductor and an A4-size white original and an A4-size halftone-image original, which are wider than B5 size paper, are copied, then the toner components and paper dust adherent to those areas of the organic-photoconductor surface which correspond to those two edges of B5-size sheets are transferred to the copy of the A4-size white original or halftone-image original to form black streaks having a width of 1 mm or smaller. Based on this phenomenon, the adhesion of toner components and paper dust can be ascertained.

In addition, since those areas of the photoconductor to which magnetic particles have adhered have impaired photoconductivity, those areas retain a higher potential than the normal areas after the charging step and the subsequent exposure step. As a result, those areas of the organic-photoconductor surface attract toner in the development step to soil the copy. Specifically, the copy of the A4-size white original or halftone-image original is soiled with black spots of about 1 mm.

Thereafter, tone reproduction was evaluated with a Kodak gray scale.

The results of the above evaluations are shown in Table 2.

TABLE 2

| Sample No. | Adhesion of Toner Component and Paper Dust to Photoconductor Surface | Adhesion of Magnetic Particles to Photoconductor Surface | Amount of Consumed Toner (g/1000 sheets) | Toner Reproduction (number of gradation steps) |
|---|---|---|---|---|
| Example 1 | Good | Good | Good (38) | Good (6 steps) |
| Example 2 | Good | Good | Good (40) | Good (6 steps) |
| Example 3 | Good | Good | Good (41) | Good (6 steps) |
| Example 4 | Good | Good | Good (41) | Good (6 steps) |
| Example 5 | Good | Good | Good (38) | Good (6 steps) |
| Example 6 | Good | Good | Good (40) | Good (6 steps) |
| Example 7 | Good | Good | Good (41) | Good (6 steps) |
| Example 8 | Good | Good | Good (37) | Good (6 steps) |
| Example 9 | Good | Good | Good (42) | Good (6 steps) |
| Comparative Example 1 | Good | spot soil | Good (41) | Good (6 steps) |
| Comparative Example 2 | black streak soil | Good | Good (39) | Good (6 steps) |
| Comparative Example 3 | black streak soil | Good | Good (39) | Good (6 steps) |
| Comparative Example 4 | black streak soil | spot soil | Good (40) | Good (6 steps) |
| Comparative Example 5 | black streak soil | spot soil | Good (42) | Good (6 steps) |

The evaluation results given in Table 2 show the following. The electrophotographic toners of Examples 1 to 9 according to the present invention were free from the adhesion of toner components, paper dust, and magnetic particles to the surface of the organic photoconductor. Consequently, these toners did not cause any soil in the form of black streaks or spots on the copies of the A4-size white original and halftone-image original. (The toners which gave satisfactory copies of the white and halftone-image originals are indicated by "Good".) The consumption of each of these toners was as small as 42 g or below per 1,000 sheets, and the toners also showed satisfactory tone reproduction with 6-step gradation.

In contrast, in Comparative Example 1, magnetic particles adhered to the surface of the organic photoconductor and, hence, the copies of the white and halftone-image originals were soiled with about from forty to fifty black spots of about 1 to 2 mm.

In Comparative Examples 2 and 3, toner components and paper dust adhered to the surface of the organic photoconductor and, hence, the copies of the white and halftone-image originals were soiled with black streaks.

In Comparative Example 4, employing almost spherical magnetic particles, the copies of the white and halftone-image originals were soiled with black streaks as in Comparative Example 2 and further with about from thirty to forty black spots as in Comparative Example 1.

In Comparative Example 5, employing amorphous magnetic particles having a smaller proportion of sharp edges than hexahedral or octahedral particles, the copies of the white and halftone-image originals were soiled with black streaks as in Comparative Example 2 and further with about from forty-five to fifty black spots as in Comparative Example 1.

The electrophotographic toner of the present invention is free from the adhesion of toner components and paper dust to the surface of an organic photoconductor in a high-humidity atmosphere. Therefore, the toner of the present invention produces the effects of prolonging the service life of the organic photoconductor and being capable of continuously giving high-quality copies or prints over a prolonged period of time.

While the invention has been described in detail and with reference to specific embodiments thereof, it will be apparent to one skilled in the art that various changes and modifications can be made therein without departing from the spirit and scope thereof.

What is claimed is:

1. An electrophotographic toner for use in an image-forming apparatus employing an organic photoconductor said toner comprising:

toner particles, and adherent to the surface of said toner particles, magnetic particles having an FeO content of 17% by weight or lower, a specific surface area of from 2.5 to 6 $m^2/g$, and an octahedral or hexahedral particle shape.

2. The electrophotographic toner of claim 1, wherein the amount of said magnetic particles adherent to said toner particles is from 0.3 to 3% by weight based on the total amount of said toner particles and said magnetic particles.

3. The electrophotographic toner of claim 1, wherein the magnetic particles have an FeO content of 3 to 17% by weight.

4. The electrophotographic toner of claim 1, wherein the magnetic particles have an FeO content of 5 to 17% by weight.

* * * * *